US006658866B2

(12) United States Patent
Tang et al.

(10) Patent No.: US 6,658,866 B2
(45) Date of Patent: Dec. 9, 2003

(54) SCROLL EXPRESSOR

(75) Inventors: Yan Tang, Manlius, NY (US); James W. Bush, Skaneateles, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/074,815

(22) Filed: Feb. 13, 2002

(65) Prior Publication Data

US 2003/0150223 A1 Aug. 14, 2003

(51) Int. Cl.[7] ..... F25B 1/00; F25B 43/00; F25D 9/00

(52) U.S. Cl. ..... 62/116; 62/498; 62/115; 62/402; 62/512; 418/6; 418/60

(58) Field of Search ..... 62/498, 115, 512, 62/116, 402; 418/5, 6, 3, 60

(56) References Cited

U.S. PATENT DOCUMENTS 4,192,152 A * 3/1980 Armstrong et al. ..... 62/402
4,515,539 A * 5/1985 Morishita ..... 418/55.1
4,650,405 A * 3/1987 Iwanami et al. ..... 418/5
4,677,949 A * 7/1987 Youtie ..... 123/235
5,247,795 A * 9/1993 McCullough ..... 60/605.1
5,293,850 A * 3/1994 Nishida ..... 123/235
5,911,743 A * 6/1999 Shaw ..... 62/84
5,947,694 A * 9/1999 Hablanian ..... 417/201
6,321,564 B1 * 11/2001 Yamanaka et al. ..... 62/510

* cited by examiner

*Primary Examiner*—William C. Doerrler
*Assistant Examiner*—Filip Zec
(74) *Attorney, Agent, or Firm*—Carlson, Gaskey & Olds

(57) ABSTRACT

A scroll expresser of a refrigerant system includes a non-orbiting expander scroll plate and an orbiting expander scroll plate which form a plurality of expansion chambers and a non-orbiting compressor scroll plate and a orbiting compressor scroll plate which form a plurality of compression chambers. The scroll expresser expands high pressure refrigerant in the expansion chambers to low pressure vapor refrigerant and liquid refrigerant. The liquid refrigerant exits the scroll expresser for evaporation. The vapor refrigerant is compressed in the compression chambers and mixes with the refrigerant exiting the compressor. Alternatively, the orbiting scroll plates are integrated into one component.

25 Claims, 5 Drawing Sheets

SCROLL EXPRESSOR

BACKGROUND OF THE INVENTION

The present invention relates generally to a scroll expresser for use in a refrigeration system.

Scroll compressors are utilized in many refrigerant systems. After compression of a refrigerant in the scroll compressor to a high pressure, the refrigerant is cooled in a condenser and expanded to a low pressure in an expansion device. After heating of the refrigerant in an evaporator, the refrigerant again enters the scroll compressor, completing the cycle.

Scroll compressors include two opposed interfitting scroll plates each having a base and a generally spiral wrap extending from the base. The opposed scroll members define compression chambers. One of the two scroll members is driven to orbit relative to the other by a shaft. As the wraps orbit, refrigerant in the compression chambers are reduced in volume, increasing the pressure of the refrigerant.

It is desirable to increase efficiency of a refrigeration system. In all phase changing refrigeration systems, energy is lost at the expansion valve. It would be desirable to employ a refrigeration system with a device in place of an expansion valve which utilizes or recovers the energy of the expansion process in a more efficient manner.

SUMMARY OF THE INVENTION

The refrigerant system of the present invention employs a scroll expressor in place of an expansion valve. A non-orbiting expander scroll plate and an orbiting expander scroll plate form a plurality of expansion chambers. A non-orbiting compressor scroll plate and an orbiting compressor scroll plate form a plurality of compression chambers. The orbiting compressor scroll plate is keyed to the orbiting expander scroll plate such that the orbiting scroll plates move in the same direction and at the same speed. The orbiting scroll plates move by an off-center crank piece. As the center of mass of the crank piece and the orbiting scroll is not centered, a counter weight is employed to balance the radial inertial force due to the uncentered mass and prevent radial loading.

Refrigerant enters the expansion chambers through a high pressure refrigerant inlet. In the expansion chambers, the high pressure refrigerant is expanded to a mixture of low pressure vapor refrigerant and liquid refrigerant. The expanded liquid refrigerant exits the scroll expresser through a low pressure discharge. The low pressure vapor refrigerant flows into the compression chambers for compression. Any excess vapor not ingested by the compressor exits the expressor through the low pressure discharge. A separation element prevents passage of the liquid refrigerant into the compression chambers. After compression of the vapor refrigerant in the compression chambers, the refrigerant is discharged through a high pressure vapor discharge and mixes with refrigerant exiting the system compressor which is connected to the scroll expressor in parallel. Preferably, the volume ratio of the expansion chambers is greater than the volume ratio of the compression chambers.

A spring positioned between the orbiting expander scroll plate and the orbiting compressor scroll plate reduces both axial loading and axial clearance in the scroll expresser. The spring counteracts the tendency of the high pressure gases in the compression chambers to separate the orbiting compressor scroll plate from the non-orbiting compressor scroll plate. The spring also counteracts any gaps which may form due to wearing of the scroll plates and cause leakage.

Alternatively, the orbiting scroll plates may be integrated into one component. A drive mechanism with a combined crank piece and counterweight guides the orbiting scroll plate to cause expansion and compression of the refrigerant.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
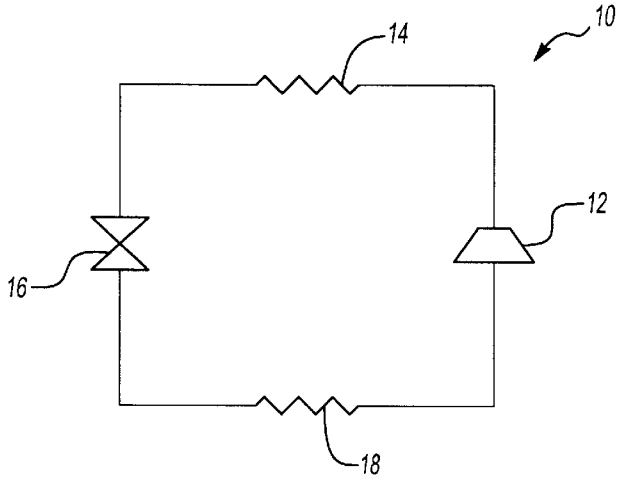
Fig-1 PRIOR ART
FIG. 1 illustrates a schematic diagram of a prior art refrigerant system.

FIG. 1 illustrates a schematic diagram of a prior art refrigerant system 10 including a compressor 12, a condenser 14, an expansion device 16, and an evaporator 18. After refrigerant vapor exits the compressor 12 at high pressure and enthalpy, the refrigerant flows through the condenser 14 where the refrigerant condenses into a liquid, exiting at low enthalpy and high pressure. The liquid refrigerant is then expanded to a low pressure liquid-vapor mixture in the expansion device 16 followed by heating in the evaporator 18. The refrigerant exits the evaporator 18 generally as a vapor at low pressure and intermediate enthalpy. The vapor refrigerant is then compressed in the compressor 12, completing the cycle 10.

Figure 2:
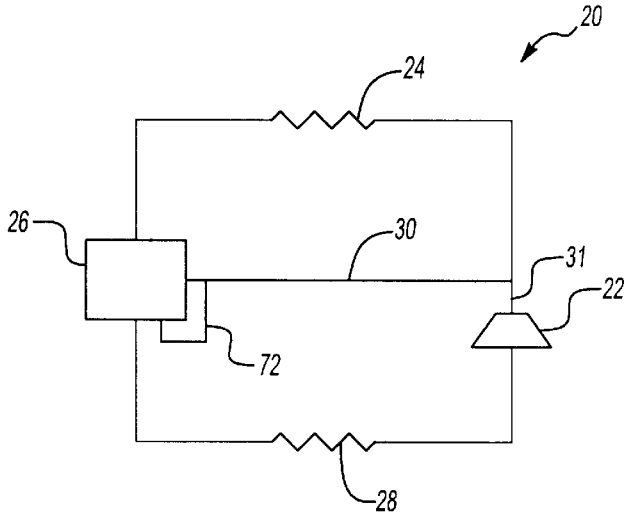
FIG. 2 illustrates a schematic diagram of the refrigerant system of the present invention employing a scroll expresser.

FIG. 2 illustrates a schematic diagram of a refrigeration system 20 employing the scroll expressor 26 of the present invention. The system 20 includes a system compressor 22, a condenser 24, the scroll expresser 26, and an evaporator 28. Refrigerant circulates through the closed circuit system 20. After refrigerant exits the system compressor 22 at high pressure and enthalpy, refrigerant is cooled and condensed in the condenser 24, exiting at low enthalpy and high pressure. It is to be understood that system compressor 22 can be any type of compressor. The high pressure low enthalpy liquid refrigerant is then expanded to a low pressure in the scroll expresser 26, producing both liquid refrigerant and vapor refrigerant. The low pressure low enthalpy liquid refrigerant exits the expressor 26 after expansion and is heated and vaporized in the evaporator 28 followed by compression in the system compressor 22. The low pressure vapor refrigerant exiting the expansion process is at an intermediate enthalpy similar to the vapor refrigerant exiting the evaporator. The low pressure vapor refrigerant is compressed in the scroll expresser 26 and exits as a high pressure high enthalpy vapor through an expressor vapor discharge line 30 which merges with the discharge 31 of the system compressor 22. The scroll expressor 26 and the system compressor 22 are thus connected in parallel through their respective high pressure discharge lines.

Figure 3:
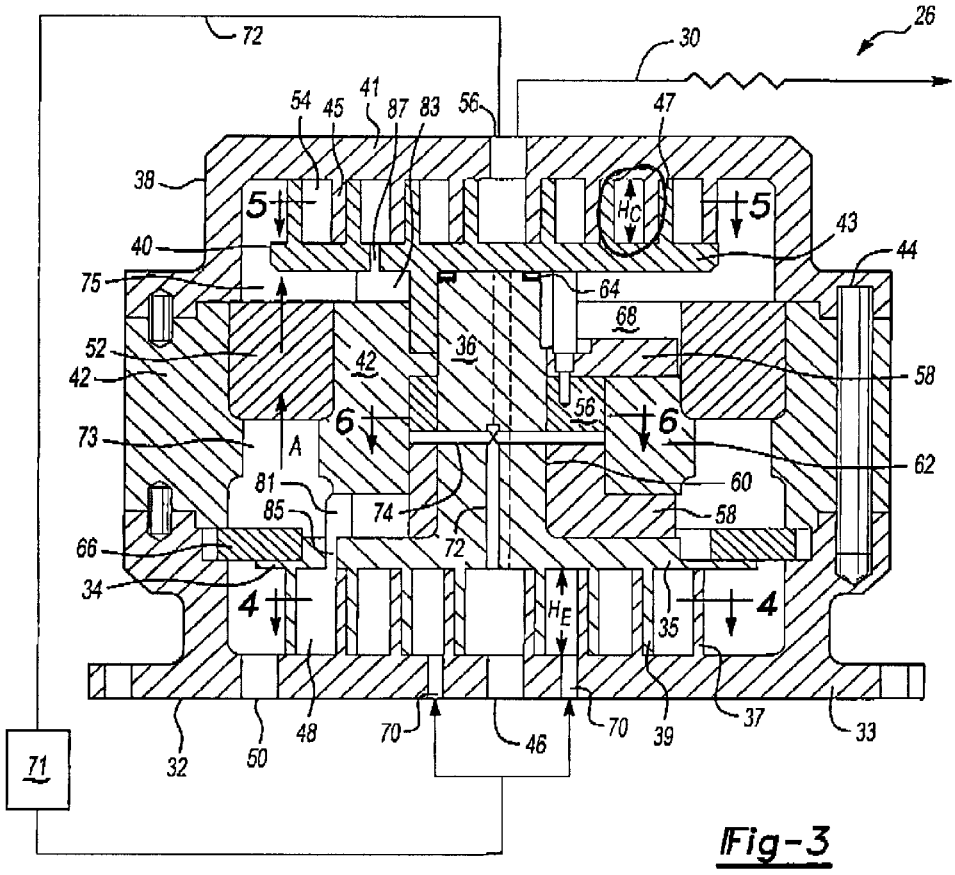
FIG. 3 illustrates the scroll expresser of the present invention.

FIG. 3 illustrates the scroll expressor 26 of the present invention. The scroll expresser 26 can be utilized in any refrigeration, air conditioning or heat pump system. The scroll expressor 26 includes a non-orbiting expander scroll plate 32 and an orbiting expander scroll plate 34 with a shaft 36 which define a plurality of expansion chambers 48. The expander scroll plates 32 and 34 each include a base 33 and 35, respectively, and a generally spiral wrap 37 and 39, respectively. The scroll expressor 26 further includes a non-orbiting compressor scroll plate 38 and an orbiting compressor scroll plate 40 which define a plurality of compression chambers 54. The compressor scroll plates 38 and 40 each include a base 41 and 43, respectively, and a generally spiral wrap 45 and 47, respectively. The orbiting compressor scroll plate 40 is keyed to the orbiting expresser scroll plate 34 by a key 68. An Oldham coupling 66 prevents the orbiting expander scroll 34 from rotating. As the orbiting compressor scroll 40 is connected to the orbiting expander scroll 34 by the key 68, the orbiting compressor scroll 40 is also prevented from rotating. The non-orbiting expander scroll plate 32 and the non-orbiting compressor scroll plate 38 are connected to an expressor body 42 by a dowel pin 44.

Refrigerant is supplied to the expansion chambers 48 through a high pressure refrigerant inlet 46. The expansion chambers 48 have a height $H_E$ and a volume ratio $V_E$. In the expansion chambers 48, the refrigerant is expanded to a low pressure liquid refrigerant and a low pressure vapor refrigerant. After expansion of the refrigerant in the expansion chambers to a low pressure, the liquid refrigerant exits the scroll expressor 26 through the low pressure liquid discharge 50 for evaporation in the evaporator 28 followed by compression in the system compressor 22. A portion of the low pressure vapor refrigerant also exits through the low pressure liquid discharge 50. However, it is to be understood that a portion of the low pressure vapor refrigerant can exit through a separate low pressure outlet which bypasses the evaporator 24 and returns directly to the system compressor 22 inlet. A separation element 52 prevents passage of the liquid refrigerant into the compression chambers 54 but allows passage of the vapor refrigerant to the plurality of compression chambers 54. After expansion, the low pressure liquid and vapor expanded refrigerant flows into a first chamber 73 located above the Oldham coupling 66. The remainder of the low pressure vapor refrigerant flows along path A from the expander outlet chamber 73 through the separation element 52 and to the compressor inlet chamber 75 to the compression chambers 54. As the separation element 52 prevents the flow of liquid refrigerant through the separation element 52, the expanded liquid refrigerant exits the scroll expressor 26 through the low pressure liquid outlet 50. As stated above, a portion of the low pressure vapor refrigerant also exits through the low pressure liquid outlet 50. The separation element 52 prevents the passage of liquid refrigerant from the expander outlet chamber 73 to the compressor inlet chamber 75.

The low pressure vapor refrigerant is compressed in the compression chambers 54. After compression, the refrigerant in the compression chambers 54 is discharged through the high pressure vapor discharge 56 and flows along the expressor vapor discharge line 30 to mix at the compressor discharge 31 with the high pressure refrigerant exiting the system compressor 22.

As the liquid refrigerant entering expansion chambers 48 has a much lower specific volume than the vapor refrigerant exiting the compression chambers 54 and the specific volume of the vapor refrigerant exiting the expansion chambers 48 is the same as the vapor refrigerant entering the compression chambers 54, the volume ratio $V_C$ of the compression chambers 54 is preferably less than the volume ratio $V_E$ of the expansion chambers 48. Also, as the power generated by the expansion process is generally less than that power required to recompress the total vapor flow exiting the expansion chambers 48, the height $H_C$ of the compression chambers 54 is generally less than the height $H_E$ of the expansion chambers 48 in order to reduce the compressor inlet volume to an appropriate value below the expander outlet volume. Alternatively, other parameters of the scroll wrap such as pitch, wall thickness, or wrap angles may also be varied between the expander wraps 37 and 39 and the compressor wraps 45 and 47 in order to define a reduced compressor inlet volume. However, it should be understood that preferably the orbiting radius of both sets of wraps 37, 39, 45, and 47 should be the same or nearly the same in order that the expander orbiting scroll plate 34 directly drives the compressor orbiting scroll plate 40. As the height $H_C$ is generally less than the height $H_E$, a portion of the low pressure vapor refrigerant discharges through the low pressure liquid outlet 50 or through another discharge which will assure the eventual return of the refrigerant to the inlet of system compressor 22. However, it is to be understood that full compression of the low pressure vapor refrigerant is possible if the expander power output is augmented or otherwise balanced with the compressor power input.

Figure 4:
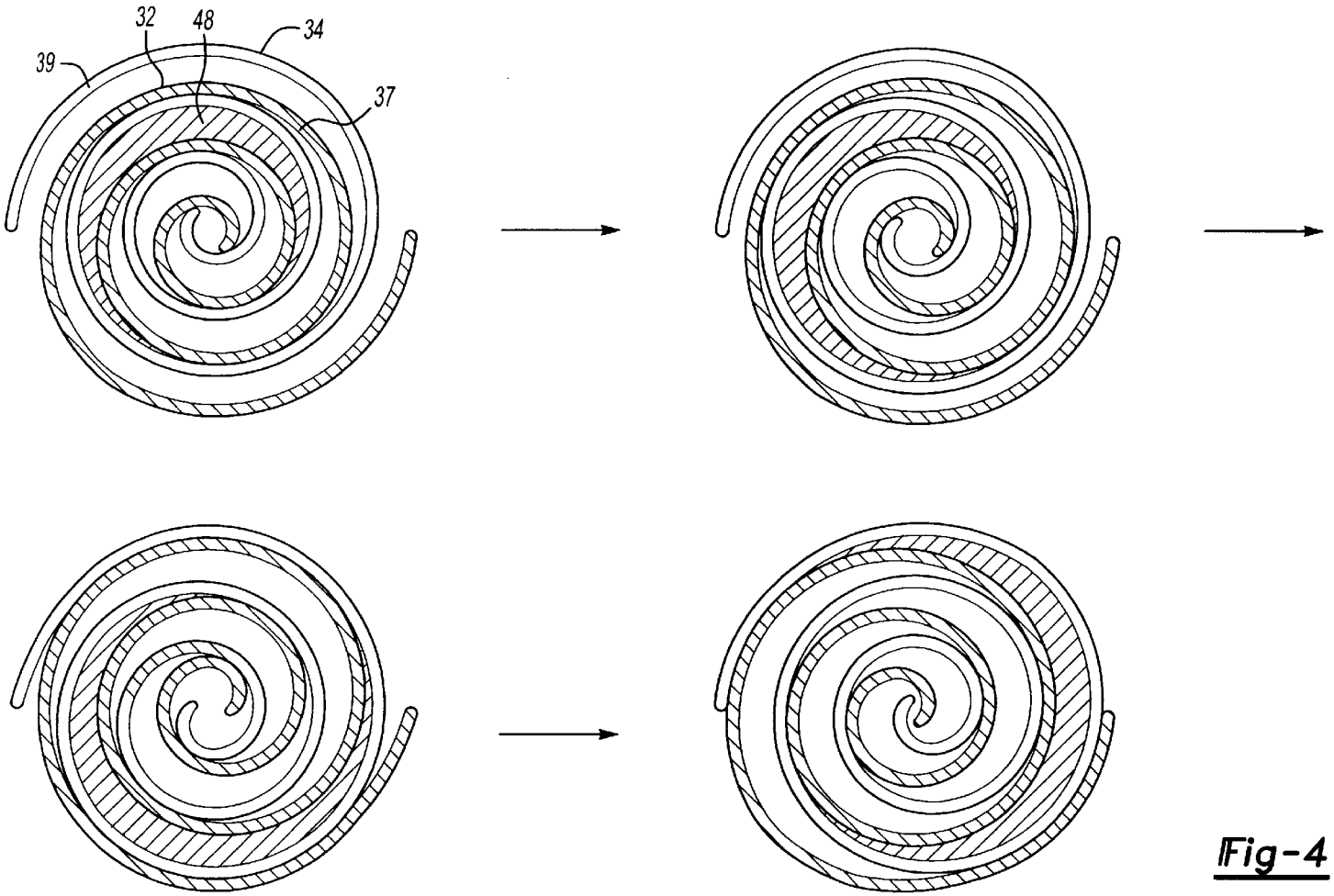
FIG. 4 illustrates a cross sectional view of the scroll expressor of FIG. 3 taken along lines 4—4 showing the orbiting of the expansion scrolls.
Figure 5:
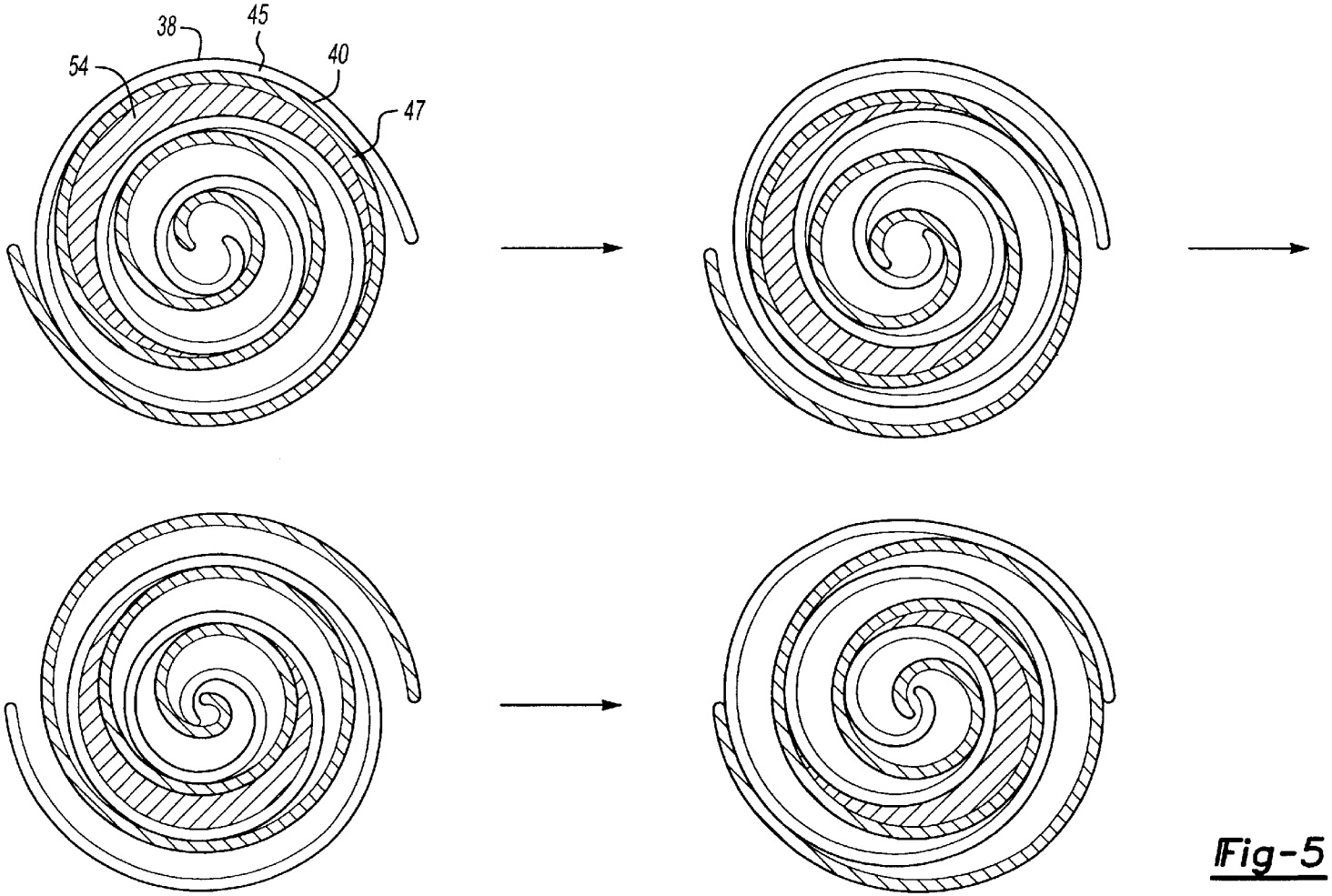
FIG. 5 illustrates a cross sectional view of the scroll expressor of FIG. 3 taken along lines 5—5 showing the orbiting of the compressor scrolls.

FIGS. 4 and 5 illustrate the scroll expresser 26 taken along line 4—4 and lines 5—5 of FIG. 3, respectively. As the orbiting scroll plates 34 and 40 are connected by the key 68, the orbiting scroll plates 34 and 40 move in the same direction and at the same speed. As shown, the profiles of the generally spiral wraps 45 and 47 of the compressor scroll plates 38 and 40 are preferably the same as the profiles of the generally spiral wraps 37 and 39 of the expansion scroll plates 32 and 34. However, the direction of the generally spiral wraps 37 and 39 of the expansion scroll plates 32 and 34 are opposite to the direction of the generally spiral wraps 45 and 47 of the compression scroll plates 38 and 40. Therefore, as the shaft 36 orbits, the compression chambers 54 compress the refrigerant and the expansion chambers 48 expand the refrigerant.

Figure 6:
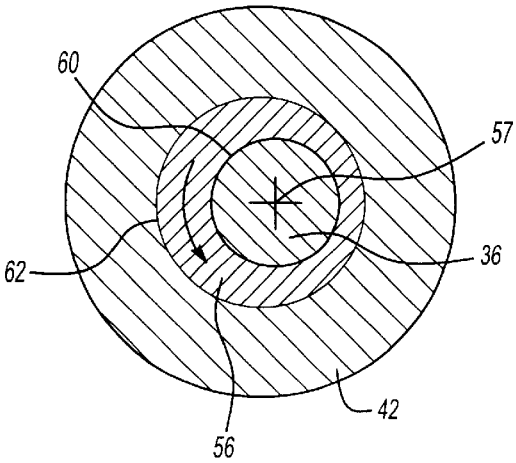
FIG. 6 illustrates a cross sectional view of the scroll expresser of FIG. 3 taken along lines 6—6 showing the crank piece and the shaft.

FIG. 6 illustrates the scroll expresser 26 taken along line 6—6 of FIG. 3. An off-center crank piece 56 guides the orbiting motion of the shaft 36. As the center of mass 57 of the shaft 36 is not centered, a counterweight 58 (shown in FIG. 3) is employed to counteract radial inertia loading. An inner sleeve bearing 60 and an outer sleeve bearing 62 are positioned proximate to the interior and exterior, respectively, of the crank piece 56.

Returning to FIG. 3, high pressure refrigerant from the expansion chambers 48 flows through lubrication channels 72 and 74 to lubricate the sleeve bearings 60 and 62. As high pressure lubrication is provided to the bearings 60 and 62, a hydrostatic bearing 60 and 62 design is possible.

A spring 64 is positioned around the shaft 36 between the orbiting expander scroll plate 34 and the orbiting compressor scroll plate 40. The spring 64 reduces both axial clearance and axial loading in the scroll expressor 26. High pressure gases in the compression chambers 54 tend to push the orbiting compressor scroll plate 40 downwardly and away from the corresponding non-orbiting compressor scroll plate 38, creating axial loading. The spring 64 counteracts this loading and provides a restoring force on the orbiting compressor scroll plate 40, preventing leakage of refrigerant from the compression chambers 54. Additionally, by choosing $H_C$, $V_C$, $H_E$, $V_E$, and the number of generally spiral wraps 37, 39, 45 and 47 of the scrolls plates 32, 34, 38, and 40, a good axial seal in the compressor chambers 54 can be created, further reducing axial loading.

The spring 64 also reduces axial clearance in the scroll expresser 26. As the scroll expresser 26 operates, the scroll plates 32, 34, 38 and 40 tend to wear, causing leakage of refrigerant and reducing efficiency. The spring 64 applies force on the orbiting scroll plates 34 and 40, allowing the orbiting scroll plates 34 and 40 to maintain engagement with non-orbiting scroll plates 32 and 38, respectively, thus reducing leakage of vapor refrigerant due to wear. As the refrigerant in the expansion chambers 48 is about 80% liquid, the liquid refrigerant in the expansion chambers 48 creates an additional seal to further block leakage of the vapor refrigerant from the expansion chambers 48.

The scroll expressor 26 also preferably includes a pair of high pressure vapor inlets 70. After compression of the refrigerant in the compression chambers 54, most of the high pressure refrigerant flows along the expresser line 30 to mix with refrigerant exiting the system compressor 22 at the discharge 31. A small amount of high pressure vapor refrigerant is diverted to enter the expansion chambers 48 through the high pressure vapor inlets 70. The high pressure vapor refrigerant is used to adjust the revolutions per minute of the shaft 36, allowing for different capacities of the scroll expressor 26 to be achieved. A control 71 provides the ability to achieve the capacity control.

High pressure vapor refrigerant in the expansion chambers 48 and the compression chambers 54 tend to separate the orbiting scroll plates 34 and 40 from the non-orbiting scroll plates 32 and 38, respectively. Preferably, either or both of the orbiting expander scroll plate 34 and the orbiting compressor scroll plate 40, respectively, include a hole 85 and 87. The holes 85 and 87 allow high pressure vapor refrigerant to escape into sealed back-pressure chambers 81 and 83 provided behind either or both the orbiting expander scroll plate 34 and the orbiting compressor scroll plate 40, respectively.

This provides a restoring force to counteract the separating forces as system operating conditions change. However, it is to be understood that either or both of the non-orbiting expander and compressor scroll plates 32 and 38, respectively, can be adapted to move axially and be provided with back-pressure chambers.

Figure 8:
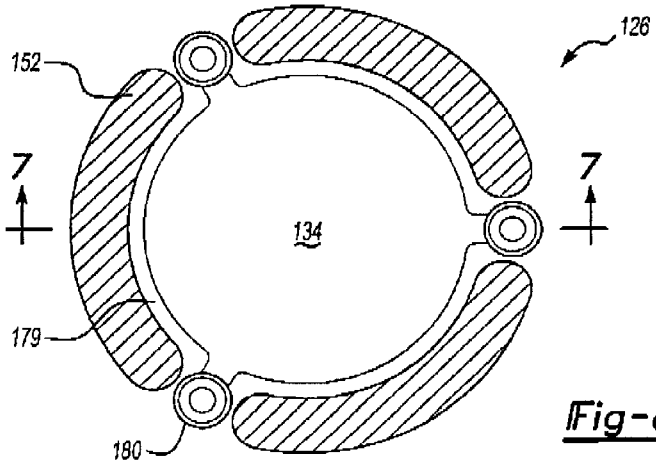
FIG. 8 illustrates a top view of the scroll expressor of FIG. 7.
Figure 7:
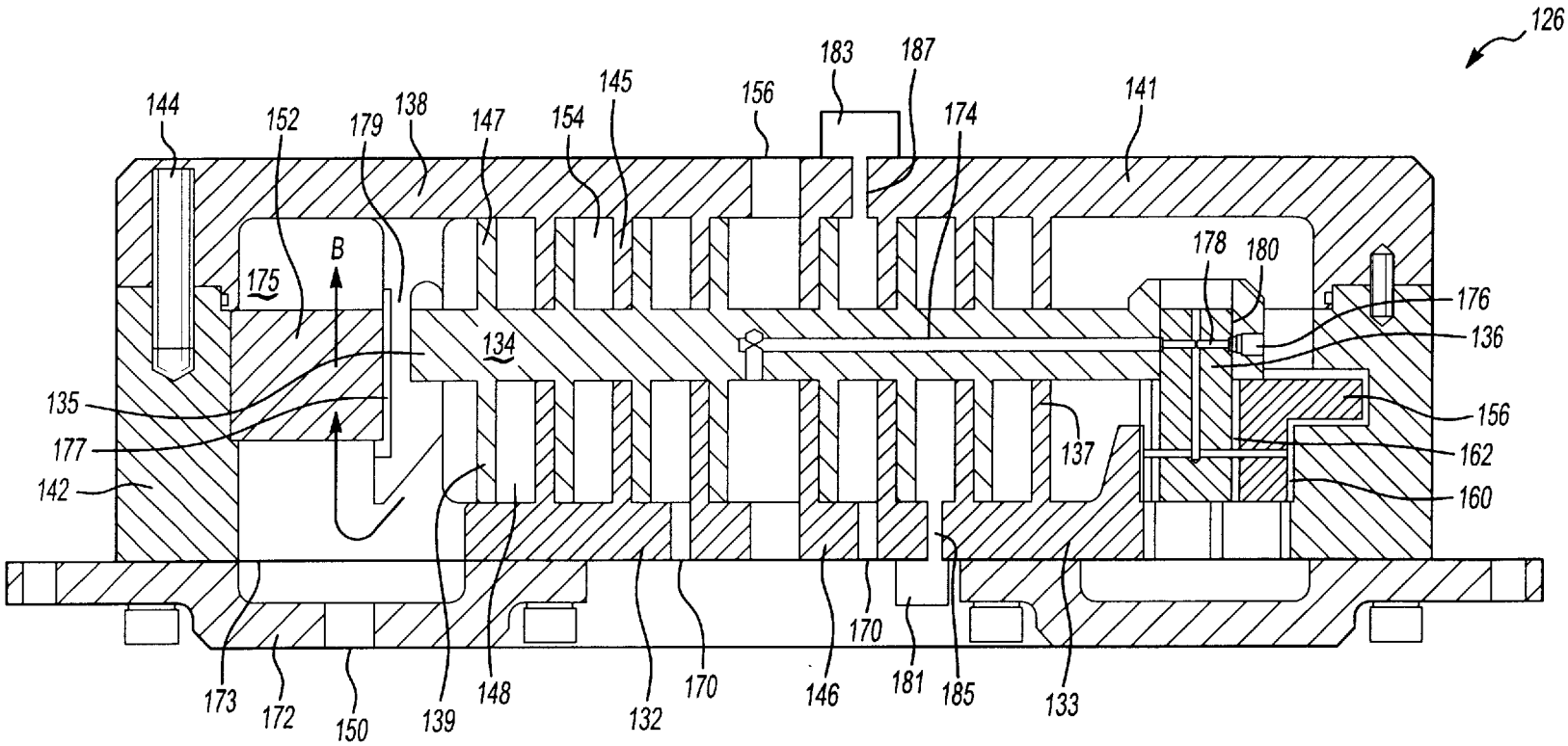
FIG. 7 illustrates an alternative scroll expresser of the present invention taken along line 7—7 of FIG. 8.

FIGS. 7 and 8 illustrate an alternative scroll expresser 126. The scroll expressor 126 includes a non-orbiting expander scroll plate 132 supported by a base plate 172, a combined orbiting expander and compressor scroll plate 134, and a non-orbiting compressor scroll plate 138. The non-orbiting expander scroll plate 132 and the non-orbiting compressor scroll plate 138 each include a base 133 and 141, respectively, and a generally spiral wrap, 137 and 145, respectively. The combined orbiting expander and compressor scroll plate 134 includes a base 135, a generally spiral expander wrap 139 and a generally spiral compressor wrap 147. High pressure refrigerant is supplied to the expansion chambers 148 formed between the scroll plates 132 and 134 through a high pressure refrigerant inlet 146. After expansion, the low pressure liquid refrigerant exits the scroll expresser 126 through the low pressure liquid discharge 150. The low pressure vapor refrigerant is compressed in the compression chambers 154 and discharged through the high pressure vapor discharger 156.

As shown in FIG. 8, the separation elements 152 prevent the low pressure liquid refrigerant from entering into the compression chambers 154. Returning to FIG. 7, after expansion, the liquid and vapor expanded refrigerant flows into a expander outlet chamber 173 proximate to the separation element 152. The vapor expanded refrigerant flows along path B from the expander outlet chamber 173 through the separation element 152 and to the compressor inlet chamber 175 to the compression chambers 154. As the separation element 152 prevents the flow of liquid refrigerant through the separation element 152, the expanded liquid refrigerant exits the scroll expressor 126 through the low pressure liquid outlet 150. The separation element 152 is located between an expressor body 142 and a wall 177. A clearance 179 exists between the wall 177 and the orbiting scroll plate 134 to allow for orbiting of the orbiting scroll plate 134. The separation element 152 prevents the passage of liquid refrigerant from the expander outlet chamber 173 to the compressor inlet chamber 175.

The scroll expresser 126 includes three drive mechanisms 180 including a combined crank piece and counterweight 156 which guides the shaft 136 to follow the motion of the orbiting scroll plate 134. An inner sleeve bearing 162 and an outer sleeve bearing 160 are positioned on the inner surface and outer surface, respectively, of the crank piece 156. Liquid refrigerant travels through a lubrication channel 174 in the orbiting scroll plates 134 and several lubrication channels 178 in the drive mechanism 180 to lubricate the bearings 160 and 162 to the drive mechanism 180. The drive mechanism 180 further includes a plug 176 employed to prevent leakage of the lubrication out of the lubrication channel 174.

To counteract the tendency of the plates 132, 134 and 138 to separate due to high pressure gases in the chambers 148 and 154, one of the non-orbiting scroll plates 132 and 138 is adapted to move axially. Only one of the fixed scroll plates 132 and 138 needs to be adapted as the same operating advantages can be realized as if both fixed scroll plates 132 and 138 were adapted. Either of the non-orbiting scroll plates 132 and 138, respectively, includes a hole 185 and 187. The holes 185 and 187 allow high pressure vapor refrigerant to escape into sealed back-pressure chambers 181 and 183, shown schematically, provided behind either the orbiting expander scroll plate 134 and the orbiting compressor scroll plate 140, respectively. The non-orbiting scroll plates 132 and 138 axially move along dowel pin 144.

There are several benefits to employing the scroll expressor 26, 126 of the present invention in a refrigeration system 20. For one, the efficiency of the refrigerant system 20 can be increased. Additionally, the scroll expresser 26 is compact and less expensive than separate compressor and expansion devices of the prior art. Additionally, using the expander power to directly compress some of the expanded vapor and return it to the system avoids the added mechanical complexity needed to transfer power from the expander to the system compressor as is done in expansion devices of the prior art.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A scroll expressor comprising:

an expansion device including a non-orbiting expander scroll member including a base and a generally spiral wrap extending from said base and an orbiting expander scroll member including a base and a generally spiral wrap extending from said base, said generally spiral wrap of said non-orbiting and orbiting expander scroll members interfitting to define a plurality of expansion chambers, and said expansion device expands a refrigerant to a low pressure; and a compression device including a non-orbiting compressor scroll member including a base and a generally spiral wrap extending from said base and an orbiting compressor scroll member including a base and a generally spiral wrap extending from said base, said generally spiral wrap of said non-orbiting and orbiting compressor scroll members interfitting to define a plurality of compression chambers, and said compression device compresses a first portion of said low pressure refrigerant to a high pressure refrigerant.

2. The scroll expressor as recited in claim 1 wherein said expansion device expands said refrigerant to a low pressure vapor refrigerant and a low pressure liquid refrigerant, said low pressure liquid refrigerant exits said expansion device through a low pressure outlet, and said low pressure vapor refrigerant includes said first portion of said low pressure refrigerant and a second portion of said low pressure refrigerant, and said second portion of said low pressure vapor refrigerant exits said expansion device through said low pressure outlet, and said compression device compresses said first portion of said low pressure refrigerant to a high pressure refrigerant which exits said compression device through a high pressure outlet.

3. The scroll expressor as recited in claim 2 wherein a separation element prevents passage of said low pressure liquid refrigerant into said plurality of compression chambers and allows passage of said low pressure vapor refrigerant into said plurality of compression chambers.

4. The scroll expressor as recited in claim 1 wherein said orbiting expander scroll member and said orbiting compressor scroll member are integrated.

5. The scroll expressor as recited in claim 1 wherein said orbiting expander scroll member and said orbiting compressor scroll member are connected by a member which restrains relative rotation between said orbiting scroll members but allows relative axial sliding therebetween.

6. A scroll expressor comprising:

an expansion device including a non-orbiting expander scroll member including a base and a generally spiral wrap extending from said base and an orbiting expander scroll member including a base and a generally spiral wrap extending from said base, said generally spiral wrap of said non-orbiting and orbiting expander scroll members interfitting to define a plurality of expansion chambers; and a compression device including a non-orbiting compressor scroll member including a base and a generally spiral wrap extending from said base and an orbiting compressor scroll member including a base and a generally spiral wrap extending from said base, said generally spiral wrap of said non-orbiting and orbiting compressor scroll members interfitting to define a plurality of compression chambers, wherein said orbiting expander scroll member and said orbiting compressor scroll member are connected by a member which restrains relative rotation between said orbiting scroll members but allows relative axial sliding therebetween, and wherein a spring is positioned between said orbiting expander scroll member and said orbiting compressor scroll member.

7. The scroll expressor as recital in claim 1 wherein a crankpiece guides a shaft to drive movement of said orbiting expander scroll member and said orbiting compressor scroll member.

8. The scroll expressor as recited in claim 7 wherein a counterweight interacts with said crankpiece.

9. The scroll expressor as recited in claim 1 wherein an anti-rotation coupling prevents rotation of said orbiting expander scroll member and said orbiting compressor scroll member.

10. A scroll expressor comprising:

an expansion device including a non-orbiting expander scroll member including a base and a generally spiral wrap extending from said base and an orbiting expander scroll member including a base and a generally spiral wrap extending from said base, said generally spiral wrap of said non-orbiting and orbiting expander scroll members interfitting to define a plurality of expansion chambers; and a compression device including a non-orbiting compressor scroll member including a base and a generally spiral wrap extending from said base and an orbiting compressor scroll member including a base and a generally spiral wrap extending from said base, said generally spiral wrap of said non-orbiting and orbiting compressor scroll members interfitting to define a plurality of compression chambers, and wherein a discharge volume of said plurality of expansion chambers is greater than an inlet volume of said plurality of compression chambers.

11. The scroll expressor as recited in claim 1 wherein said expansion device expands a refrigerant to a low pressure vapor refrigerant and a low pressure liquid refrigerant, said low pressure liquid refrigerant exits said expansion device through a low pressure outlet, and said compression device compresses said low pressure vapor refrigerant to a high pressure refrigerant which exits said compression device through a high pressure outlet.

12. A refrigeration system comprising;

a first compression device having an outlet to compress a refrigerant to a first high pressure;

a heat rejecting heat exchanger for cooling said refrigerant;

a scroll expressor including an expansion device including a non-orbiting expander scroll member including a base and a generally spiral wrap extending from said base and an orbiting expander scroll member including a base and a generally spiral wrap extending from said base, said generally spiral wrap of said non-orbiting and orbiting expander scroll members interfitting to define a plurality of expansion chambers to expand said refrigerant to a low pressure liquid refrigerant and a low pressure vapor refrigerant, said low pressure liquid refrigerant exits said expansion device through a low pressure outlet and a portion of said low pressure vapor refrigerant exits said expansion device through said low pressure outlet, and a second compression device including a non-orbiting compressor scroll member including a base and a generally spiral wrap extending from said base and an orbiting compressor scroll member including a base and a generally spiral wrap extending from said base, said generally spiral wrap of said non-orbiting and orbiting compressor scroll members interfitting to define a plurality of compression chambers to compress a remainder of said low pressure vapor refrigerant to a second high pressure which exits said compression device through a high pressure outlet;

a path leading from said high pressure outlet of said scroll expressor to mix said second high pressure refrigerant with said first high pressure refrigerant exiting said first compressor; and a heat accepting heat exchanger for evaporating said low pressure liquid refrigerant exiting said expansion device of said scroll expressor.

13. The refrigeration system as recited in claim 12 wherein a separation element prevents passage of said low pressure liquid refrigerant into said plurality of compression chambers and allows passage of said low pressure vapor refrigerant into said plurality of compression chambers.

14. The refrigeration system as recited in claim 12 wherein said orbiting expander scroll member and said orbiting compressor scroll member are integrated.

15. The refrigeration system as recited in claim 12 wherein said orbiting expander scroll member and said orbiting compressor scroll member are connected by a member which restrains relative rotation between said orbiting scroll members but which allows relative axial sliding therebetween.

16. A refrigeration system comprising:

a first compression device having an outlet to compress a refrigerant to a first high pressure;

a heat rejecting heat exchanger for cooling said refrigerant;

a scroll expressor including an expansion device including a non-orbiting expander scroll member including a base and a generally spiral wrap extending from said base and an orbiting expander scroll member including a base and a generally spiral wrap extending from said base, said generally spiral wrap of said non-orbiting and orbiting expander scroll members interfitting to define a plurality of expansion chambers to expand said refrigerant to a low pressure liquid refrigerant and a low pressure vapor refrigerant, said low pressure liquid refrigerant exits said expansion device through a low pressure outlet and a portion of said low pressure vapor refrigerant exits said expansion device through said low pressure outlet, and a second compression device including a non-orbiting compressor scroll member including a base and a generally spiral wrap extending from said base and an orbiting compressor scroll member including a base and a generally spiral wrap extending from said base, said generally spiral wrap of said non-orbiting and orbiting compressor scroll members interfitting to define a plurality of compression chambers to compress a remainder of said low pressure vapor refrigerant to a second high pressure which exits said compression device through a high pressure outlet, and wherein said orbiting expander scroll member and said orbiting compressor scroll member are connected by a member which restrains relative rotation between said orbiting scroll members but which allows relative axial sliding therebetween; and a spring is positioned between said orbiting expander scroll member and said orbiting compressor scroll member; and a path leading from said high pressure outlet of said scroll expressor to mix said second high pressure refrigerant with said first high pressure refrigerant exiting said first compressor;

a heat accepting heat exchanger for evaporating said low pressure liquid refrigerant exiting said expansion device of said scroll expressor.

17. The refrigeration system as recited in claim 12 wherein a crankpiece guides a shaft to drive movement of said orbiting expander scroll member and said orbiting compressor scroll member.

18. The refrigeration system as recited in claim 17 wherein a counterweight interacts with said crankpiece.

19. The refrigeration system as recited in claim 12 wherein an anti-rotation coupling prevents rotation of said orbiting expander scroll member and said orbiting compressor scroll member.

20. A refrigeration system comprising:

a first compression device having an outlet to compress a refrigerant to a first high pressure;

a heat rejecting heat exchanger for cooling said refrigerant;

a scroll expressor including an expansion device including a non-orbiting expander scroll member including a base and a generally spiral wrap extending from said base and an orbiting expander scroll member including a base and a generally spiral wrap extending from said base, said generally spiral wrap of said non-orbiting and orbiting expander scroll members interfitting to define a plurality of expansion chambers to expand said refrigerant to a low pressure liquid refrigerant and a low pressure vapor refrigerant, said low pressure liquid refrigerant exits said expansion device through a low pressure outlet and a portion of said low pressure vapor refrigerant exits said expansion device through said low pressure outlet, and a second compression device including a non-orbiting compressor scroll member including a base and a generally spiral wrap extending from said base and an orbiting compressor scroll member including a base and a generally spiral wrap extending from said base, said generally spiral wrap of said non-orbiting and orbiting compressor scroll members interfitting to define a plurality of compression chambers to compress a remainder of said low pressure vapor refrigerant to a second high pressure which exits said compression device through a high pressure outlet;

a path leading from said high pressure outlet of said scroll expressor to mix said second high pressure refrigerant with said first high pressure refrigerant exiting said first compressor, and a heat accepting heat exchanger for evaporating said low pressure liquid refrigerant exiting said expansion device of said scroll expressor, and wherein a discharge volume of said plurality of expansion chambers is greater than an inlet volume of said plurality of compression chambers.

21. A method of refrigeration comprising the steps of:

1) providing a refrigerant cycle including a first compression device, a heat rejecting heat exchanger, a scroll expressor including an expansion device and a second compression device, and a heat accepting heat exchanger;

2) cooling said refrigerant in said heat rejecting heat exchanger;

3) expanding said refrigerant in said expansion device to a low pressure liquid refrigerant and a low pressure vapor refrigerant;

4) evaporating said low pressure liquid refrigerant in said heat accepting heat exchanger;

5) compressing said refrigerant to a first high pressure in said first compression device;

6) compressing said low pressure vapor refrigerant to a second high pressure in said second compression device; and 7) mixing said second high pressure refrigerant with said first high pressure refrigerant.

22. The scroll expressor as recited in claim 1 wherein a resilient member is positioned between said orbiting expander scroll member and said orbiting compressor scroll member.

23. The scroll expressor as recited in claim 12 wherein a resilient member is positioned between said orbiting expander scroll member and said orbiting compressor scroll member.

24. The scroll expressor as recited in claim 1 wherein said expansion device and said compression device communicate radially outwardly of a radially innermost location.

25. The scroll expressor as recited in claim 12 wherein said expansion device and said compression device communicate radially outwardly of a radially innermost location.

* * * * *

UNITED STATES PATENT AND TRADEMARK OFFICE

CERTIFICATE OF CORRECTION

PATENT NO. : 6,658,866 B2
DATED : December 9, 2003
INVENTOR(S) : Tang et al.

It is certified that error appears in the above-identified patent and that said Letters Patent is hereby corrected as shown below:

Column 8,
Line 14, “recital” should be -- recited --

Signed and Sealed this

Thirteenth Day of April, 2004

JON W. DUDAS
*Acting Director of the United States Patent and Trademark Office*